United States Patent [19]

Stutzman

[11] Patent Number: 4,886,010

[45] Date of Patent: Dec. 12, 1989

[54] CLOTHING WEAR MONITORING DEVICE

[76] Inventor: Ralph Stutzman, 5025 Knollcrest Ct., Indianapolis, Ind. 46208

[21] Appl. No.: 247,913

[22] Filed: Sep. 22, 1988

[51] Int. Cl.[4] ..... G09F 9/40; G09F 3/14

[52] U.S. Cl. ..... 116/308; 40/322; 116/311; 116/315; 116/318; 223/85; D6/328

[58] Field of Search ..... 116/308, 309, 311, 312, 116/315, 316, 318, 285, 223, 306, 307, 317, 327, 335; 40/113, 115, 322, 495, 496, 907; 223/85; 235/78 R, 88 R, 119; D6/328

[56] References Cited

U.S. PATENT DOCUMENTS

| | | | |
|---|---|---|---|
| 493,851 | 3/1893 | Adsit | 116/307 |
| 576,834 | 2/1897 | Chapman | 116/308 |
| 916,563 | 3/1909 | Kristofek . | |
| 1,076,929 | 11/1913 | Williamson . | |
| 1,161,381 | 11/1915 | Duffy . | |
| 1,382,331 | 6/1921 | Thomas . | |
| 1,441,914 | 1/1923 | Deisch . | |
| 2,244,514 | 6/1941 | Cwiekalo | 40/113 |
| 2,336,742 | 12/1943 | Maguire | 35/74 |
| 2,496,942 | 2/1950 | Hill | 235/88 |
| 2,693,864 | 11/1954 | Ferro | 116/200 |
| 2,710,489 | 6/1955 | Myers, Jr. | 40/322 |
| 2,724,552 | 11/1955 | Sherwood | 235/78 |
| 2,901,167 | 8/1959 | Mudge | 235/61 |
| 2,993,288 | 7/1961 | Rothman | 40/70 |
| 3,030,016 | 4/1962 | Rudduck | 235/114 |
| 3,124,284 | 3/1964 | Collum | 40/322 |
| 3,210,866 | 10/1965 | Brunelle | 35/74 |
| 3,259,311 | 7/1966 | Sama et al. | 235/78 |
| 3,432,942 | 3/1969 | Jack | 35/31 |
| 3,486,691 | 12/1969 | Rodriguez | 235/88 |
| 3,493,172 | 2/1970 | Bromage | 116/318 |
| 3,578,241 | 5/1971 | Wombough | 235/88 |
| 3,627,200 | 12/1971 | Sadler | 235/88 |
| 3,633,294 | 1/1972 | Burmeister | 40/299 |
| 4,048,477 | 9/1977 | Hungerford | 235/86 R |
| 4,599,087 | 7/1986 | Smetaniuk et al. | 235/116 |
| 4,756,104 | 7/1988 | Bailey | 40/322 |

FOREIGN PATENT DOCUMENTS

| | | | |
|---|---|---|---|
| 1166645 | 11/1958 | France | 116/318 |

*Primary Examiner*—William A. Cuchlinski, Jr.
*Assistant Examiner*—W. Morris Worth
*Attorney, Agent, or Firm*—Harness, Dickey & Pierce

[57] ABSTRACT

There is disclosed a garment wear monitor for recording the number of times an article of clothing is worn. The monitor is removably or permanently affixed to a clothing hanger, or is removably affixed to the garment directly. Each time the garment is worn the garment wear monitor is advanced by one number manually or automatically. The garment wear monitor may also display the date on which the garment was last cleaned. A threshold indicator serves to remind the user to have the garment cleaned when a predetermined number of wearings have taken place. The garment wear monitor may display the number of wearings and the date of last cleaning by a mechanically movable scale or by an electronic digital display.

15 Claims, 4 Drawing Sheets

CLOTHING WEAR MONITORING DEVICE

BACKGROUND AND SUMMARY OF THE INVENTION

The present invention relates to a clothing wear monitoring device and, more particularly, to a device for monitoring the number of times a garment has been worn and for displaying the date on which the garment was last cleaned.

The garment wear monitor is located on or near the garment to be monitored. The monitor contains an easily readable display that indicates the number of times the garment has been worn. The monitor also comprises an advancing means for advancing the number displayed by one numeral each time the garment is worn. The monitor may also comprise a means for displaying the date, in particular, the month and year, in which the garment was last cleaned. By using the garment wear monitor in accordance with the present invention, the garment user is able to quickly and easily determine the total number of times the garment has been worn. Alternatively, the garment user can record the date on which the garment was last cleaned, and the number of times the garment has been worn since the last cleaning by resetting the numerical display to zero each time the garment is cleaned.

It is frequently a problem for persons to determine when a particular garment should be cleaned. Some garments are cleaned after each wearing, or a garment may obviously need cleaning due to a spot or stain. Frequently, however, garments are not cleaned until after they have been worn a number of times. As a result, by relying merely upon memory or visual inspection, it may be difficult for the wearer to determine whether a particular garment needs cleaning or not. Because of this, it is difficult to establish a regular cleaning schedule that is suitable for the individual's wearing habits, work environment and individual preference. Consequently, some garments may be overcleaned, or undercleaned, because the user does not recall how many times a garment has been worn between cleanings, or does not recall the last time the garment has been cleaned.

An additional problem addressed by the present invention is that of determining the number of times a garment has been worn for the purpose of more evenly distributing the wearing of various articles of clothing. While an individual may desire to wear, for example, a given number of suits an equal number of times, without realizing it, the user may wear some suits more frequently than others. As a result, those suits may wear out faster than the other suits. In addition, it is difficult for an individual to determine how many times an article of clothing has been worn before it wears out. This makes it difficult to evaluate the durability of a particular type or brand of garment.

It is therefore desirable to provide a garment wear monitoring device to record and display the number of times a garment is worn so that an individual can evaluate and compare the durability of various types of garments.

It is also desirable to provide a garment wear monitor which tracks the number of times a garment is worn so that the wearing of various garments can be evenly distributed among the garments to prevent one garment from becoming overused and wearing out before the others.

It is further desirable to provide a garment wear monitor which displays the number of times a garment is worn between cleanings so that the wearer can adhere to a cleaning schedule to avoid over or undercleaning the garment. It is still further desirable to provide a garment wear monitor which also records the date of the last cleaning of the garment so that the individual can have the garment cleaned at regular time intervals.

DETAILED DESCRIPTION OF THE PREFERRED EMBODIMENTS

Figure 1:
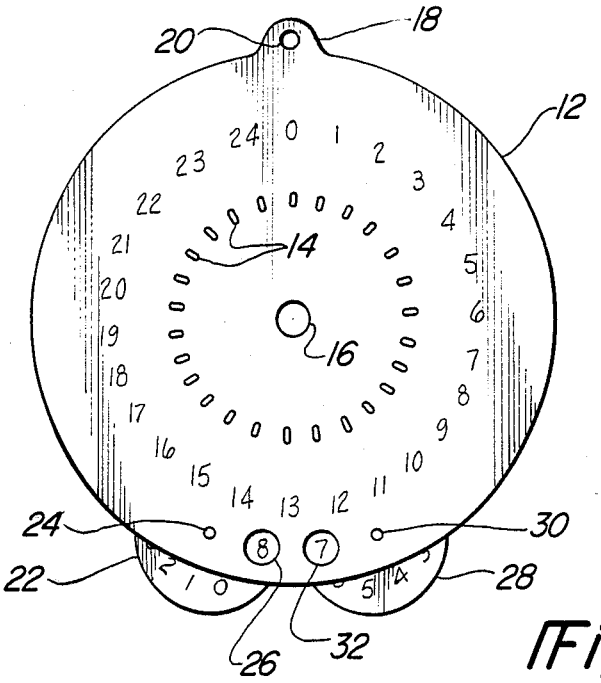
FIG. 1 is a front plan view of the baseplate for the garment wear monitor of the present invention.
Figure 4:
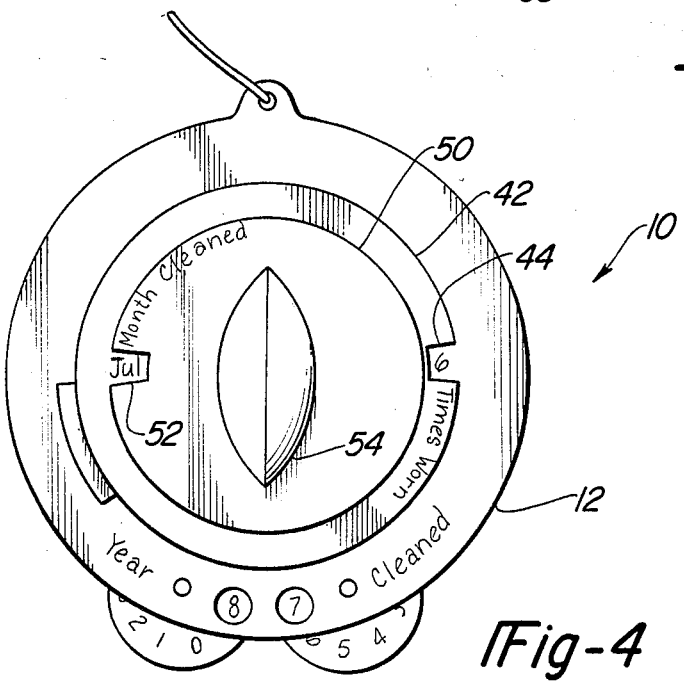
FIG. 4 is a front plan view of the garment wear monitor with the top plate installed in accordance with the present invention.

Referring now to the drawings, the garment wear monitor in accordance with the present invention, is shown in FIG. 4 at 10. A baseplate 12, shown in FIGS. 1 and 4, comprises a rigid disc-shaped plate having a radial series of numbers located towards the outer edge of the baseplate 12. A series of notches 14, shown in FIG. 1, are located at positions corresponding to the numbers, but located radially inward from each number. The notches 14 each comprise an elongated depression in the baseplate 12. The number of notches 14 and corresponding numbers is chosen to permit a desired maximum number of wearing times to be recorded. For example, in FIG. 1, the numbers 0 through 24 are on the baseplate 12, so that 24 is the maximum number of wearings that can be recorded. A central opening 16 is also shown in FIG. 1 on the baseplate 12. This opening 16 will permit a shaft to be inserted for the purpose of attaching the various components of the garment wear monitor 10 which will be described below.

The baseplate 12 also has a radially extended portion 18 at the top which includes a second opening 20. The second opening 20 permits the garment wear monitor 10 to be attached to a hanger, as more fully described below. A year indicator is also incorporated into baseplate 12. The year indicator comprises a first disc 22 which is mounted upon and rotates about an axis 24 located at the lower portion of the baseplate 12. This disc 22 has the numbers 0 through 9 around its outer perimeter. A first window 26 in the backplate 12 permits a single one of the numbers on the disc 22 to be viewed. Likewise, a second disc 28 is mounted on, and rotates about, an axis 30 at the lower portion of the baseplate 12. The second disc 28 also has the numbers 0 through 9 at its outer perimeter, and a second window 32 in the baseplate 12 permits a single one of these numbers to be viewed. The first and second windows 26, 32 are in close proximity to permit the two numbers in the windows to be viewed together. A portion of the first disc 22 and the first disc 28 protrudes radially beyond the baseplate 12 permitting each disc to be easily manually rotated by the user. In this way, the user can turn the first disc 22 and the second disc 28 until the desired year is displayed in the first and second windows 26, 32. Each axis 24, 30 may comprise a conventional bolt or rivet capable of fastening the first disc 22 and the second disc 28 while permitting rotation about the axis 24, 30. As shown in FIG. 4 the words "Year Cleaned" or other suitable words are printed on the baseplate 12 to indicate that the two numbers visible through the first and second windows 26, 32 correspond to the last two digits of the last year that a particular garment was cleaned.

In FIG. *2a*, the baseplate 12 is shown with a threshold indicator plate 34 installed. The threshold indicator plate 34 is a disc-shaped plate having a smaller diameter than the ring of numbers on the baseplate 12, so that the threshold indicator plate 34 does not obstruct the view of these numbers. A protruding portion 36 preferably comprises a red colored, semi-transparent material which permits the number or numbers behind it to be viewed while accentuating those numbers with its red color.

In FIG. *2b*, the threshold indicator plate 34 is shown in cross section along line *2b—2b* in FIG. *2a*. It can be seen in FIG. *2b* that there are two spurs 38 protruding downward from the back surface of the threshold indicator 34. These may be more than two or as many spurs 38 as there are notches 14, as long as the spacing between the spurs 38 is the same as the spacing between the notches 14. Thus, with the threshold indicator 34 mounted on top of the baseplate 12, spurs 38 will mate with the notches 14. The threshold indicator plate 34 also has a central opening 40 about which it will rotate. When threshold indicator 34 is rotated about the central opening 40 by turning the protruding portion 36, it will likely be rotated in discrete positions corresponding to the movement of spurs 38 into successive notches 14. When using the garment wear monitor 10, the threshold indicator 34 is rotated until the protruding portion 36 covers predetermined number or numbers which correspond to the number of times it is desired to wear a garment before it is cleaned. In this way, the threshold indicator serves as a reminder to have the garment cleaned.

Figure 3:
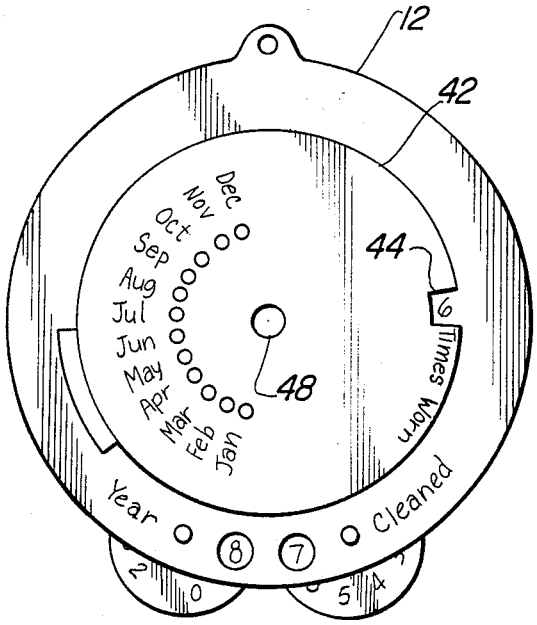
FIG. 3 is a front plan view of the garment wear monitor with the month indicator plate installed in accordance with the present invention.
Figure 2A:
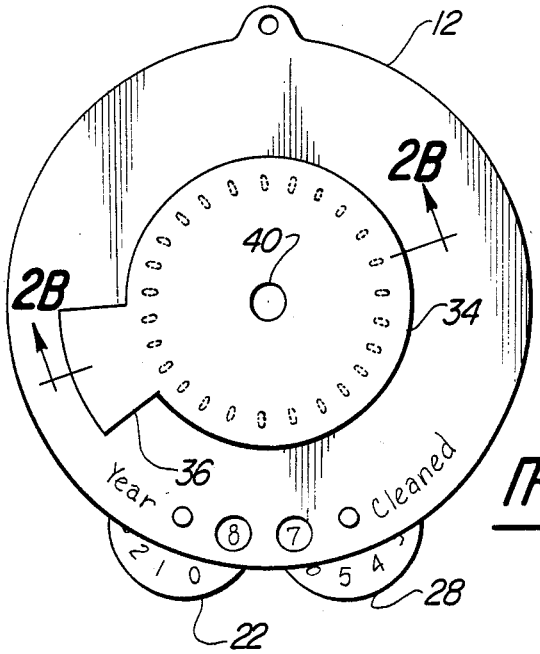
FIG. 2*a* is a front plan view of the baseplate with the threshold indicator plate attached in accordance with the present invention.
Figure 2B:
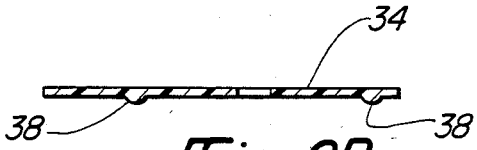
FIG. 2*b* is a cross sectional elevational view of the threshold indicator plate taken at line 2*b*—2*b* in FIG. 2.

In FIG. 3, the garment wear monitor 10 is shown with the addition of a month dial 42 having a window portion 44. The words "Times Worn" are printed on the month dial 42 adjacent to the window portion 44. The window portion 44 is positioned so that it permits a single one of the series of numbers on the baseplate 12 to be viewed. The month dial 42 also has the months of the year printed on it in a radial pattern near the outer perimeter. Adjacent to each printed month is a hole 46. The month dial 42 also has a central opening 48 about which it may be rotated.

In FIG. 4, the garment wear monitor 10 is shown with the top plate 50 installed. The top plate 50 has a window 52 located in a position corresponding to the location of the months printed on the month dial 42 below the window 52. The words "Month Cleaned" are printed adjacent to the window 52. The window 52 permits a single one of the months on the month dial 42 to be viewed. This will indicate the last month the garment was cleaned. The top plate 50 also has a raised knob 54 at its center to permit the top plate 50 to be rotated by hand. The diameter of the top plate 50 is smaller than the month dial 42 thus permitting the words "Times Worn" on the month dial to be viewed.

Figure 5:
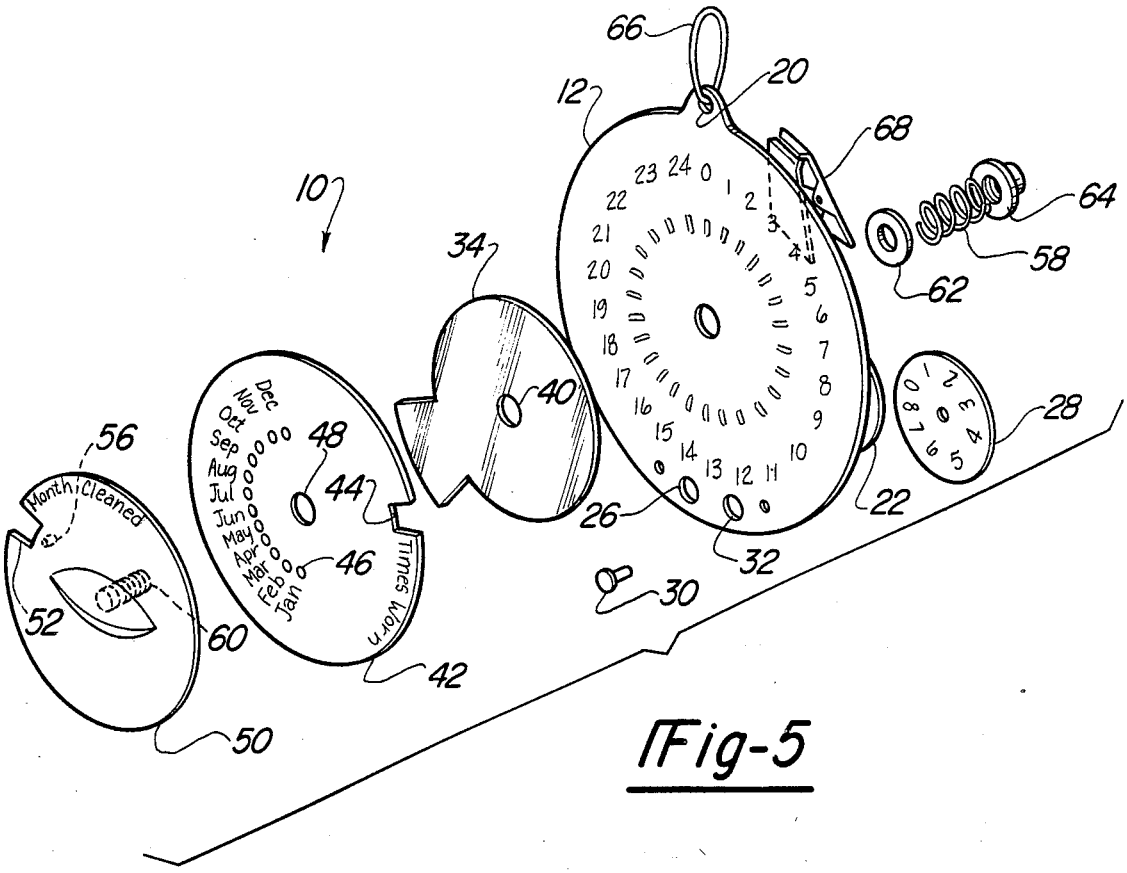
FIG. 5 is an exploded perspective view of the garment wear monitor and associated mounting hardware in accordance with the present invention.

Referring now to FIG. 5, the top plate 50 is shown in a perspective view partially in cross section. It can be seen that an alignment peg 56 protrudes from the bottom of the top plate 50. The alignment peg 56 is adjacent the window 52 and is slightly smaller in diameter than the holes 46 in the month dial 42. When the top plate 50 is placed over and adjacent the month dial 42, the peg 56 may be inserted into one of the holes 46 corresponding to the month the garment was last cleaned. In this way, when the top plate 50 is turned by means of the raised knob 54, with the peg 56 inserted into one of the holes 46, the month dial 42 will turn along with top plate 50. In this way, each time the garment is worn rotation of the top plate 50 by means of the raised knob 54 will cause the month dial 42 to rotate permitting a different number to be read adjacent the words "Times Worn".

When the garment is cleaned, the top plate 50 and month dial 42 may be rotated so that the times worn displayed is reset to 0. Also, upon cleaning the garment, the year can be set by means of manually rotating the first and second discs 22, 28 until the correct year appears in the windows 26, 32. To set the month, the top plate 50 is pulled outwardly with the raised knob 54 causing the peg 56 to come out of one of the holes 46 and the top plate 50 is then rotated until the correct month appears in the opening 52. The top plate 50 is then pushed inwardly against the month dial 42 until the peg 56 is reinserted into one of the holes 46. To facilitate the reinsertion and to hold the peg 56 into one of the holes 46, a spring 58 is installed, as shown in FIG. 5. Top plate 50 also has a center shaft 60 attached to the raised knob 54 protruding downward therefrom. To assemble the various components of the garment wear monitor 10, the center shaft 60 is inserted first into the opening 48 in the month indicator 42, then into the opening 40 in the threshold indicator 34, and then into the center opening 16 in the backplate 12. A flat washer 62 is then inserted over the center shaft 60, and the spring 58 is also placed over the center shaft 60. Finally, a cap nut 64 is screwed onto the end of the center shaft 60. In this way, the entire assembly of the garment wear monitor 10 is held together while at the same time the various components may be permitted to rotate as desired about the center shaft 60. When it is desired to change the month cleaned indicated in the top plate window 52, the raised knob 54 may be pulled outward and the top plate 50 rotated to the correct position. This will cause additional compression on spring 58 which will permit the top plate 50 and the peg 56 to be pulled back into one of the holes 46.

Also shown in FIG. 5 is a strap 66 which is looped around the opening 20 in the baseplate 12. The strap 66 permits the garment wear monitor 10 to be slipped over the hook of a garment hanger and attached thereby to the hanger. For those garments that are not hung on a hanger, a clip 68 may be provided on the back of the baseplate 12. The clip 68 may be used to attach the garment wear monitor 10 to any convenient portion of the garment itself or a tag thereon. The garment wear monitor will then be removed each time the garment is worn.

Figure 6:
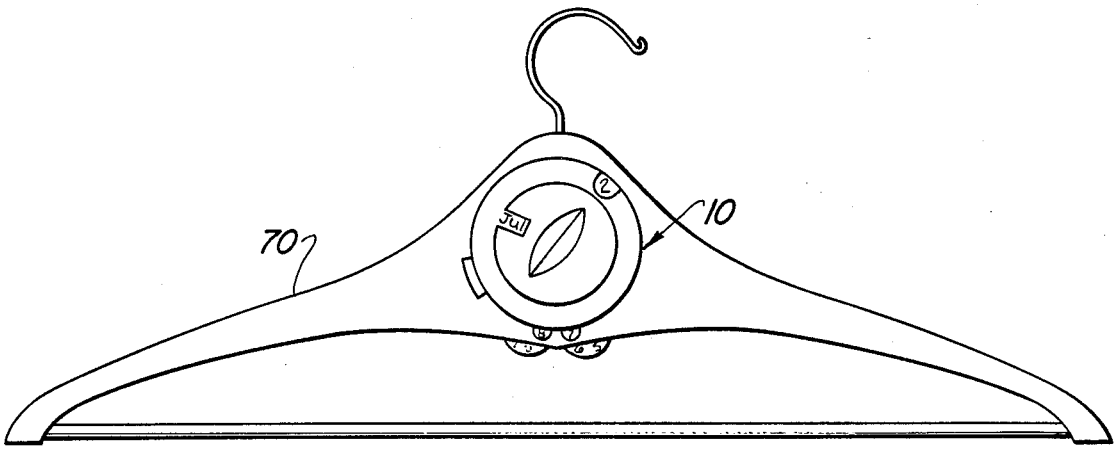
FIG. 6 is a side elevational view of the garment wear monitor incorporated into a garment hanger.

A second embodiment of the present invention is shown in FIG. 6. In this embodiment, the garment wear monitor 10 is shown permanently installed into a conventional garment hanger 70.

Figure 7:
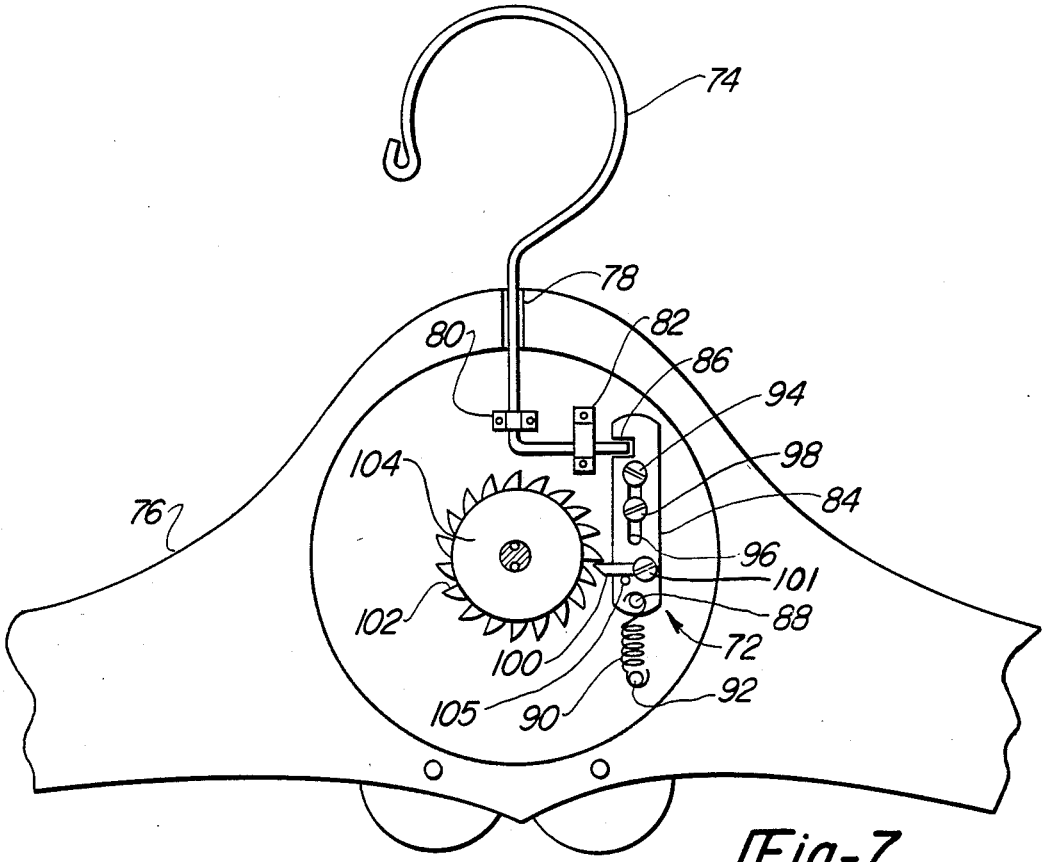
FIG. 7 is a rear elevational view of a garment wear monitor with an automatic advancing mechanism in accordance with the present invention.

In a third embodiment of the present invention shown in FIG. 7, a mechanism 72 is provided which automatically advances the top plate 50 to the next "Times Worn" position. In an embodiment such as the ones in FIGS. 6 and 7, where the garment wear monitor 10 is mounted on a clothes hanger 70, this advancing mechanism 72 may be advanced by the action of removing or replacing the garment on the hanger. In particular, in FIG. 7 a hanger hook 74 is movably mounted to a hanger 76 by means of an axial opening 78 in the hanger 76, and two fasteners 80, 82. These fasteners 80, 82 secure the hanger hook 74 to the surface of the hanger 76 but also permit the hanger hook 74 to move up and down a predetermined distance. A plate 84 having a slot 86 which engages with the end of the hook 74 and also a peg 88 at its lower end is slideably attached to the body of hanger 76. A spring 90 is attached to the peg 88 and also to a fixed peg 92 in the hanger 76 body. As a result of force exerted by the spring 90, the hanger hook 74 will be pulled downward into the hanger 76 by the slot 86 in the plate 84. The amount of downward motion is controlled by a screw 94 which protrudes into a slot 96 in the plate 84. When a garment is hung on the hanger 76, the weight of the garment will cause the hanger 76 to lower with respect to the hook 74. In other words, the hook 74 will be raised with respect to the hanger 76. A screw 98, protruding in the slot 96 will limit the amount of upward motion of the hook 74.

A lever 100 is rotatably mounted to the plate 84 be means of a screw 101 for engagement with a series of teeth 102 that are attached to a gear 104. A peg 105 attached to plate 84 prevents downward motion of the lever 100. The gear 104 is attached to the shaft of the monitor device such as shaft 60 shown in FIG. 5. Consequently, when the gear 104 rotates, the top plate 50 of the adjacent garment wear monitor 10 (not shown) will be rotated. This rotation will thus index or advance the month dial 42 so that a new number is visible in the Times Worn window 44.

When the garment is removed, the spring 90 will pull the hook 74 downward with respect to the hanger 76 and the lever 100 will rotate about screw 101, thereby racheting to the next lower tooth 102 on the gear 104. When the garment is again placed on the hanger 76 and the hanger is replaced in the closet, the hook 74 will again rise relative to the hanger and the next higher number will be shown on the garment wear monitor 10.

A form of the advancing mechanism 72 can be incorporated in an embodiment of the clothing wear monitor such as the one shown in FIG. 5. In such an embodiment strap 66 performs the function of hanger hook 74 and the mechanism is advanced by opposing action of strap 66, which is attached to the advancing mechanism 72, and baseplate 12.

Figure 8:
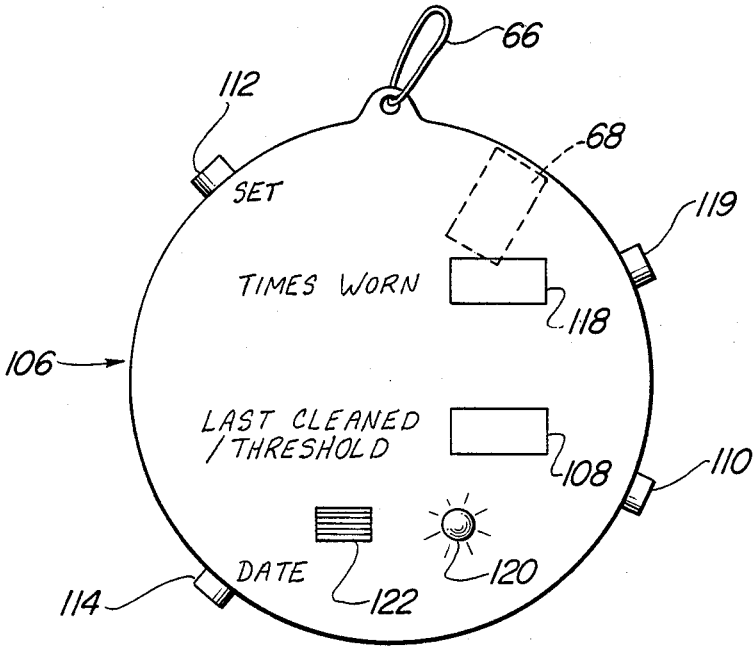
FIG. 8 is a side elevational view of an electronic garment wear monitor in accordance with the present invention.

In FIG. 8, there is shown still another embodiment of the present invention. In this embodiment, the various functions of the earlier embodiments are implemented electronically. The electronic garment wear monitor 106 comprises a front face displaying the words "Last Cleaned/Threshold". Adjacent is a date display 108 which is a conventional LED or LCD readout to display the date of the last cleaning and the desired threshold. The date of last cleaning is re-set by means of re-set buttons 110, 112 and 114. When the re-set button 110 is operated once, the last cleaning date set (month & year) will be displayed in the date display 108. Operating date button 114 one time causes the month number to flash which can be changed by a set button 112. Operating date button 114 twice causes the year number to flash which can be changed by the set button 112. Operating re-set button 110 twice displays the last threshold set and this threshold setting is changed by the set button 112. In this way, the re-set button 110 allows the user to view the date setting and the threshold setting alternately. As will be appreciated, a number of conventional, inexpensive and battery powered electronic circuits, such as an LSI microcomputer, may be used to implement the above functions.

The words "Times Worn" are also printed on the front of the garment wear monitor 106. Adjacent to the words "Times Worn" is a numerical display 118 which is capable of displaying a number and is similar to the date/threshold display 108. A fourth re-set button 119 serves to permit the times worn numerical display 118, to be advanced by one each time the garment is worn. Depressing and holding re-set button 119 for a predetermined time period will reset the times worn display 118 to zero. Advancement of the times worn display 118 may be automatic by means of a switch attached to a movable hook on a hanger, as described in connection with FIG. 7. Threshold indicators 120 and 122 may also be incorporated on the garment wear monitor 106, for indicating when the garment has been worn a predetermined number of times. The indicator 120 may be an LED which flashes when the threshold has been reached or exceeded. Indicator 122 may be of an audible alarm which beeps when the threshold has been reached or exceeded. Appropriate conventional circuitry can be provided so that indicators 120 and 122 will both automatically turn off after a predetermined time period. Thus the indicators 120 and 122 serve to notify the user visually and audibly that the threshold has been reached or exceeded. The electronic garment wear monitor 106 may be attached to a hanger by means of a strap 66 or directly to the garment by means of the clip 68 or it may be built into a hanger, similar to the garment hanger 70 shown in FIG. 6.

Thus, there is described and shown in the above description, background and drawings, a garment wear monitor which fully and effectively accomplishes the objectives thereof. However, it will be apparent that variations and modifications of the disclosed embodiments may be made without departing from the principles of the invention or the scope of the appended claims.

It is claimed:

1. A garment wear monitor for indicating the number of times a garment is worn comprising;

plate means having a numerical scale thereon;

rotatable indicator means disposed adjacent to said plate means for indicating on said numerical scale the number of times said garment has been worn;

means for removably affixing said garment wear monitor in proximity to said garment; and switch means coupled to said means for removably affixing said garment wear monitor, said switch means being responsive to the removal or affixing of said garment, said switch means also being coupled to said rotatable indicator means and capable of advancing said indicator means to the next number on said numerical scale, whereby the number of times a garment is worn is indicated on said numerical scale by the action of the user of the garment in removing or replacing of said garment.

2. A garment wear monitor for indicating the number of times a garment is worn comprising;

plate means having a numerical scale thereon;

rotatable indicator means disposed adjacent to said plate means for indicating on said numerical scale the number of times said garment has been worn;

means for removably affixing said garment wear monitor in proximity to said garment; and threshold indicator means for selectively identifying a portion of said numerical scale which corresponds to a predetermined number or numbers, whereby the user of said garment will be reminded that said garment has been worn a predetermined number of times.

3. The garment wear monitor of claim 2 wherein said threshold indicator means comprises a colored semi-transparent member, movably affixed to said plate means, disposed in front of the portion of said numerical scale which corresponds to said predetermined threshold.

4. A garment wear monitor for recording the number of times a garment is worn comprising:

a first plate means having a numerical scale thereon;

a first indicator means disposed adjacent to said first plate means for indicating on said numerical scale the number of times said garment has been worn, said first indicator means having a date scale thereon;

a second indicator means disposed adjacent to said first indicator means for indicating on said date scale the date on which said garment was cleaned; and means for removably affixing said garment wear monitor to a position in proximity to said garment.

5. The garment wear monitor of claim 4 further comprising a switch means coupled to said means for removably affixing said garment wear monitor, said switch means being responsive to the removal or affixing of said garment, said switch means also being coupled to said first indicator means and capable of advancing said first indicator means to the next number on said numerical scale, whereby the number of times a garment is worn is indicated on said numerical scale by the action of the user of the garment in removing or replacing of said garment.

6. The garment wear monitor of claim 4 wherein said means for removably affixing said garment wear monitor comprises a clip means attached to said monitor for removably affixing said garment wear monitor directly to said garment.

7. A garment wear monitor of claim 4 wherein said means for removably affixing said garment wear monitor in proximity to said garment comprises a strap means attached to said monitor for removably affixing said garment wear monitor to a hanger upon which said garment is hung.

8. The garment wear monitor of claim 4 further comprising a hanger means having a body for holding said garment when said garment is not being worn, and wherein said garment wear monitor is located integrally within the body of said hanger means.

9. The garment wear monitor of claim 4 wherein said first indicator means further comprises a rotatable disc having a window portion adjacent to said numerical scale which reveals a single number on said numerical scale;

said window portion having a width which corresponds to a width of a single number of said numerical scale, wherein said first indicator means may be rotated to a desired position causing a single number on said numerical scale to be in view and wherein said number in view is identified as corresponding to the number of times said garment has been worn.

10. The garment wear monitor of claim 4 further comprising a threshold indicator means for identifying a portion of said numerical scale which corresponds to a predetermined number or numbers, whereby the user of said garment will be reminded that said garment has been worn a predetermined number of times.

11. The garment wear monitor of claim 10 wherein said threshold indicator means comprises a colored semi-transparent member, movably affixed to said plate means, disposed in front of the portion of said numerical scale which corresponds to said predetermined number of times worn.

12. The garment wear monitor of claim 4 wherein said second indicator means is a plate disposed adjacent to said first indicator means and having a window means adjacent said date scale for displaying a portion of said date scale, and said date scale comprises each month of the year, wherein the month displayed by said window means is identified as the month in which said garment was last cleaned.

13. The garment wear monitor of claim 4 wherein said first plate means further comprises:

first and second rotatable discs each having a numerical scale thereon for indicating the year in which said garment was last cleaned, said second rotatable disc having numbers corresponding to the last digit of a year date, and said first rotatable disc having numbers corresponding to the second from the last digit of a year date; and window means adjacent each of said first and second rotatable discs for displaying a portion of said numerical scale on each of said first and second rotatable discs, wherein the year displayed by said window means is identified as the year in which said garment was last cleaned.

14. The garment wear monitor for recording the number of times a garment is worn comprising:

a disc shaped plate means having a numerical scale thereon;

a first indicator means disposed adjacent to said plate means for indicating on said numerical scale the number of times said garment has been worn, said first indicator means comprising a rotatable disc having a window portion adjacent to said numerical scale which reveals a single number on said numerical scale, and a month scale displaying each month of the year, said month scale having an opening adjacent to each month;

a second indicator means having a date scale thereon;

(a) said second indicator means disposed adjacent to said disc shaped plate means for indicating on said date scale the date on which said garment was cleaned;

a threshold indicator means for identifying the portion of said numerical scale which corresponds to a predetermined number or numbers, whereby the user of said garment will be reminded that said garment has been worn a predetermined number of times;

a third indicator means disposed adjacent to said first indicator means, said third indicator means having a window for permitting a single one of the months on said first indicator means to be viewed, and also having a handle means for permitting said third indicator means to be manually rotated, and having a peg disposed into one of said holes adjacent to said months on said first indicator means, wherein said month visible in said window on said third indicator means may be changed by manually pulling said third indicator means by said handle until said peg is withdrawn from said hole permitting said third indicator means to rotate with respect to said first indicator means; and means for removably affixing said garment wear monitor to a position in proximity of said garment.

15. The garment wear monitor of claim 14 further comprising:

a switch means coupled to said means for removably affixing said garment wear monitor, said switch means being responsive to the removal or affixing of said garment, said switch means also being coupled to said first indicator means and capable of advancing said first indicator means to the next number on said numerical scale, whereby the number of times a garment is worn is indicated on said numerical scale by the action of the user of the garment in removing or replacing of said garment.

* * * * *